US007950548B2

(12) United States Patent
Ciavarella et al.

(10) Patent No.: US 7,950,548 B2
(45) **Date of Patent: *May 31, 2011**

(54) UNIVERSAL COLLAR

(75) Inventors: Nick E Ciavarella, Seven Hills, OH (US); Mark E Rosendranz, Parma, OH (US); Detlev F Smith, Fairlawn, OH (US)

(73) Assignee: GOJO Industries, Inc., Akron, OH (US)

( * ) Notice: Subject to any disclaimer, the term of this patent is extended or adjusted under 35 U.S.C. 154(b) by 982 days.

This patent is subject to a terminal disclaimer.

(21) Appl. No.: 10/693,567

(22) Filed: Oct. 25, 2003

(65) Prior Publication Data

US 2005/0087563 A1 Apr. 28, 2005

(51) Int. Cl.
*B65D 88/54* (2006.01)

(52) U.S. Cl. ..... 222/181.3; 222/321.9; 222/325

(58) Field of Classification Search ..... 222/325, 222/105, 181.1–181.3, 321.7–321.9, 180, 222/74, 570, 573
See application file for complete search history.

(56) References Cited

U.S. PATENT DOCUMENTS

| | | | | | |
|---|---|---|---|---|---|
| 2,091,518 | A | * | 8/1937 | Murphy | 222/181.1 |
| 2,707,069 | A | * | 4/1955 | Browning et al. | 222/449 |
| 3,173,579 | A | * | 3/1965 | Curie et al. | 222/105 |
| 4,974,753 | A | * | 12/1990 | Tucker et al. | 222/325 |
| 5,033,657 | A | * | 7/1991 | Whittington | 222/181.2 |
| 5,083,678 | A | * | 1/1992 | Waring | 222/92 |
| 5,377,876 | A | * | 1/1995 | Smernoff | 222/105 |
| 5,431,309 | A | * | 7/1995 | Ophardt | 222/325 |
| 5,439,144 | A | * | 8/1995 | Holzner | 222/207 |
| 5,489,047 | A | * | 2/1996 | Winder | 222/325 |
| 5,638,989 | A | * | 6/1997 | Ophardt et al. | 222/105 |
| 5,725,131 | A | * | 3/1998 | Bell et al. | 222/196 |
| 6,082,586 | A | * | 7/2000 | Banks | 222/325 |
| 6,409,050 | B1 | * | 6/2002 | Ophardt et al. | 222/181.1 |
| 6,450,214 | B1 | * | 9/2002 | Dyer et al. | 141/9 |
| D480,639 | S | | 10/2003 | Ciaverella et al. | |
| 2007/0272709 | A9 | * | 11/2007 | Ciavarella et al. | 222/181.3 |

FOREIGN PATENT DOCUMENTS

| | | | | |
|---|---|---|---|---|
| EP | 0 519 683 | | 9/1992 | |
| GB | 2088837 | * | 6/1982 | 222/105 |

* cited by examiner

*Primary Examiner* — J. Casimer Jacyna
(74) *Attorney, Agent, or Firm* — Renner, Kenner Greive, Bobak, Taylor & Weber

(57) ABSTRACT

A universal collar that attaches to a pump and, in turn, a container used in a dispenser having a keyplate, the universal collar including: a first flange and a second flange, wherein the flanges extend radially outward and are axially spaced from each other for receiving the keyplate therebetween.

4 Claims, 4 Drawing Sheets

UNIVERSAL COLLAR

RELATED PATENT APPLICATIONS

None.

FIELD OF THE INVENTION

The present invention generally relates to a dispenser having a housing in which a container filled with a product to be dispensed is removably received. More particularly, the present invention relates to dispensers that employ a keying system for matching a container to the appropriate dispenser. Most particularly, the present invention relates to a universal collar that may be attached to the container and allow the container to be inserted in multiple dispenser housings despite any keying systems associated with those housings.

BACKGROUND OF THE INVENTION

Dispensers are commonly used to dispense fluids and powders such as lotions or soap, among others. For sake of simplicity, all dispensable products will be collectively referred to herein as "soap." These dispensers generally include a housing into which a container, such as a bag or bottle, containing the soap to be dispensed is inserted. To maximize the use of the volume within the housing, in terms of the soap stored, the container is often sized or contoured to fit a specific housing. To ensure that the proper container is used with the appropriate housing, a system of keying the containers to their appropriate housings has been developed.

One form of such a keying system incorporates a collar key that is attached to the container and interacts with a receiver within the housing to secure the container therein. To match the container to the housing, the collar key has projecting keys extending outwardly from its surface that are arranged to fit corresponding keyways formed in the receiver. For example, a container may have a collar key that includes a key in the form of an outwardly projecting vertical rib. The corresponding housing would have a keyway in the form of a vertically oriented slot sized to receive the vertical rib. By making alterations in the key shape, size or arrangement, containers have been made such that they will only fit a particular housing. In terms of manufacturing, this ensures that the proper container is used with the proper housing. From the user's perspective, this allows the user to order the correct replacement container and ensure that its maintenance staff inserts the proper container in the proper housing.

Despite these advantages, the proliferation of dispensers has led to some consumers having several different dispensers; each requiring a different container with the appropriate key. As a result, these consumers are faced with purchasing containers with several different keys. While purchasing a single container to fit all of these housings may result in a loss of capacity in some of the dispensers, consumers have indicated that simplifying the stocking and replacement of containers by providing a universal container is desirable. Aside from choosing an appropriately sized container that could be received in all of these dispensers, to provide proper fit and securement of the container within the dispenser, a collar that allows a single container to be used in multiple housings is needed.

SUMMARY OF THE INVENTION

In view of the foregoing, an object of the present invention is to provide a universal collar that may be used to fit a single container in multiple dispenser housings.

In light of this object, the present invention generally provides a universal collar that attaches to a pump and, in turn, a container used in a dispenser having a keyplate, the universal collar including a first flange and a second flange axially spaced from each other for receiving the keyplate therebetween, wherein the flanges extend radially outward relative to the pump. The present invention further provides a universal collar including a hollow cylindrical collar having a first flange and a second flange extending at least rearwardly therefrom and axially spaced to define a receiver clearance.

The present invention further provides a universal collar used in conjunction with a container for securement of the container within a soap dispenser that has a housing that defines a container recess and has a receiver that includes a keyplate, the container including a hollow body having a necked portion, a universal collar defining a bore, wherein the neck portion is receivable within the bore, and a pair of flanges extending radially outward from the collar and axially spaced from each other for receipt of the key plate therebetweeen.

The present invention further provides a dispenser including a removable container; a pump in fluid communication with the container; a housing defining a recess for receiving the container; the housing having a receiver that includes a keyplate; and a universal collar attached to the container having a first flange and a second flange that extend radially outward and are axially spaced from one another to define a clearance for receiving the keyplate therebetween, whereby upon insertion of the container within the housing, the first and second flanges axially engage the receiver at either end of the keyplate to axially secure the container within the housing.

BRIEF DESCRIPTION OF THE PREFERRED EMBODIMENTS

Figure 1:
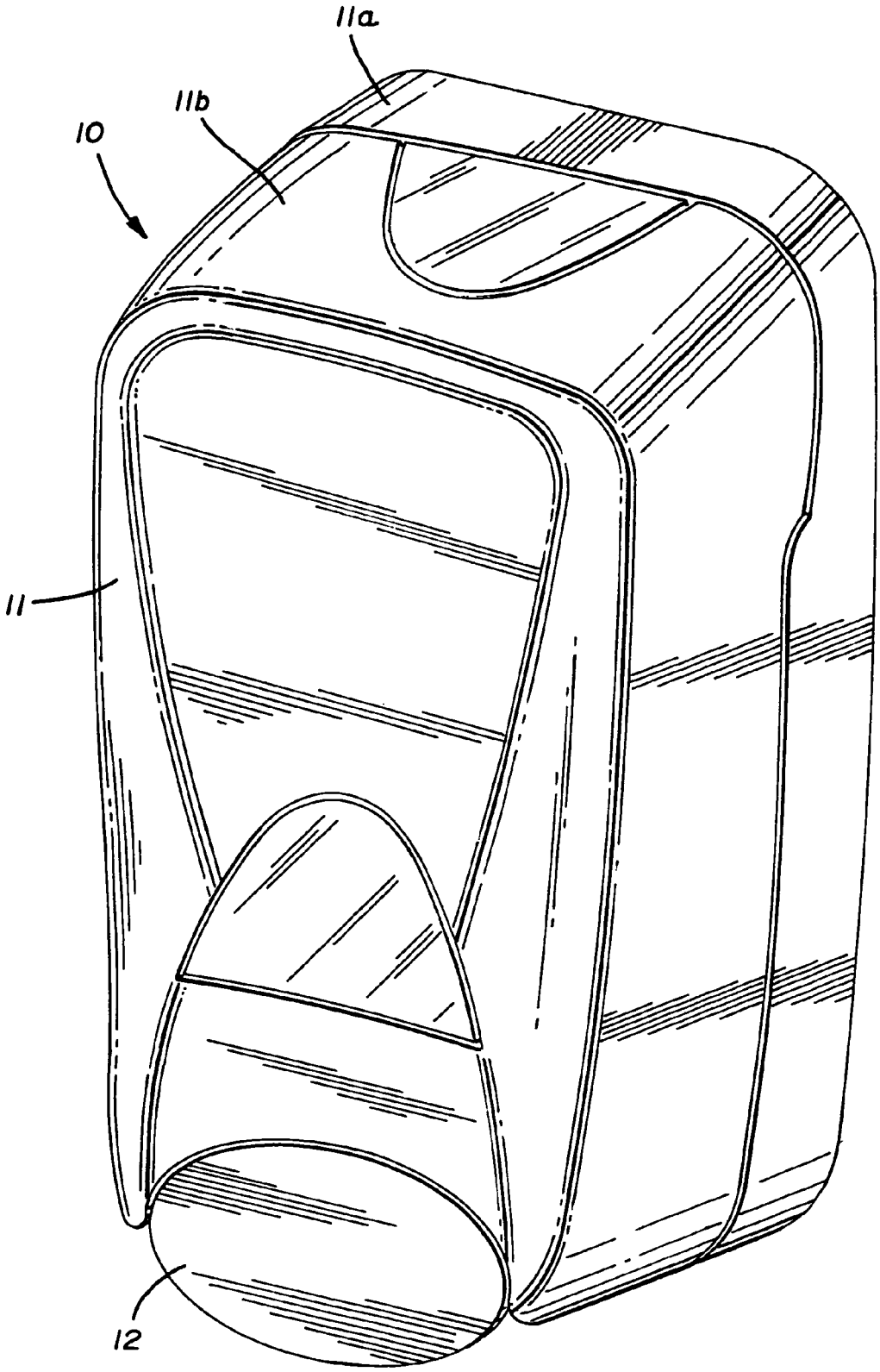
FIG. 1 is a perspective view of a dispenser according to the concepts of the present invention.

A dispenser, generally indicated by the numeral 10, is depicted in FIG. 1 of the drawings. Dispensers are widely available in the art and the dispenser 10 depicted in FIG. 1 is one example. The dispenser 10 generally includes a housing 11 that receives a container 20, such as a bag or bottle, that holds soap. The housing 11 may include a base 11*a* and a cover 11*b* which may be attached to each other in a clamshell-like fashion to facilitate replacement of an empty container 20.

Figure 2:
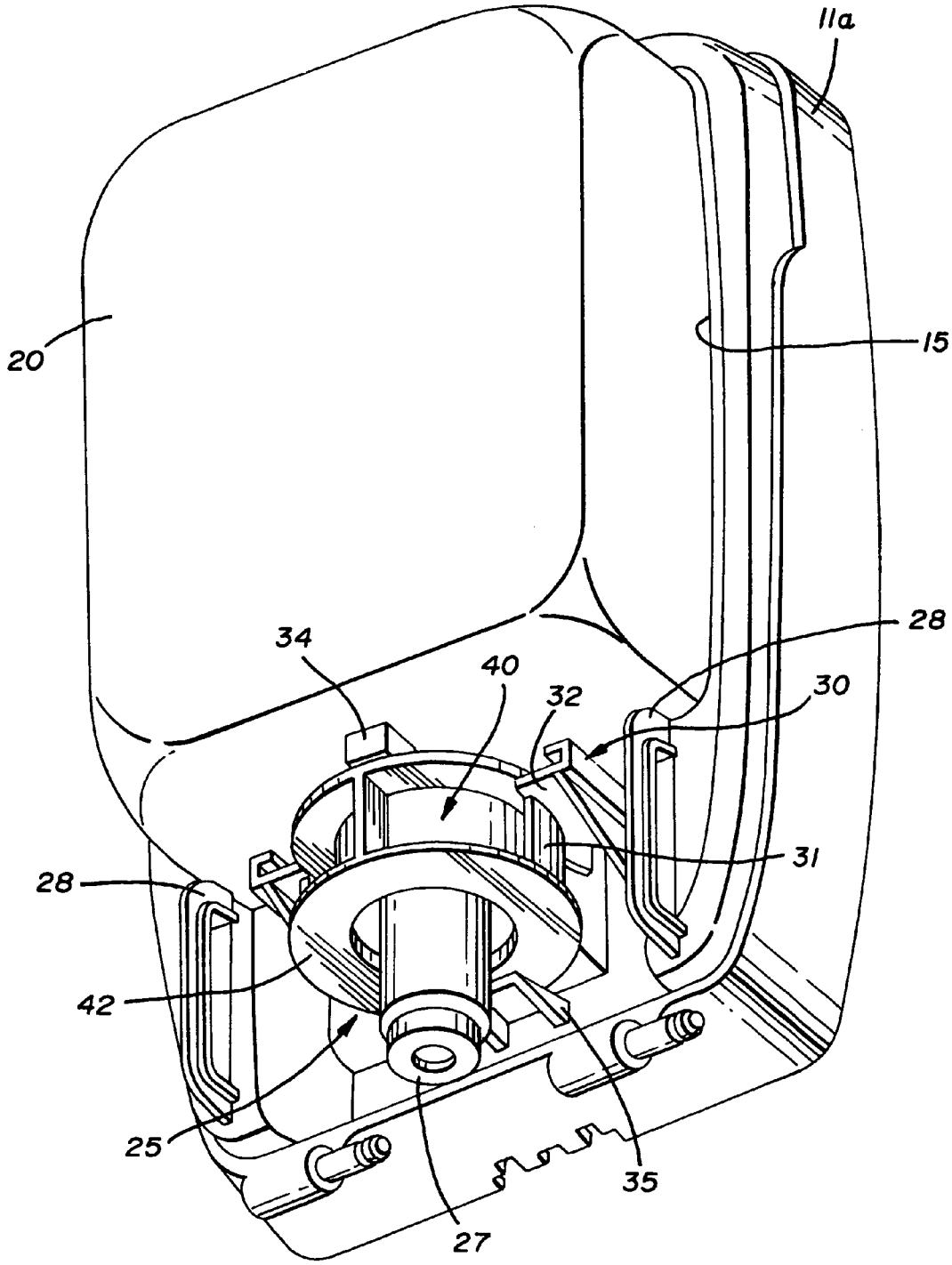
FIG. 2 is a perspective view of a dispenser according to the concepts of the present invention with the cover removed to expose a container and pump having a universal pump collar according to the concepts of the present invention seated within a base of the dispenser.

As shown in FIG. 2, the base 11*a* may define a recess 15 into which at least a portion of a container 20 is received. The base 11*a* may further include a shelf 32, which may be in the form of pair of shoulders that extend beneath the container 20 on either side of its neck 21.

Figure 3:
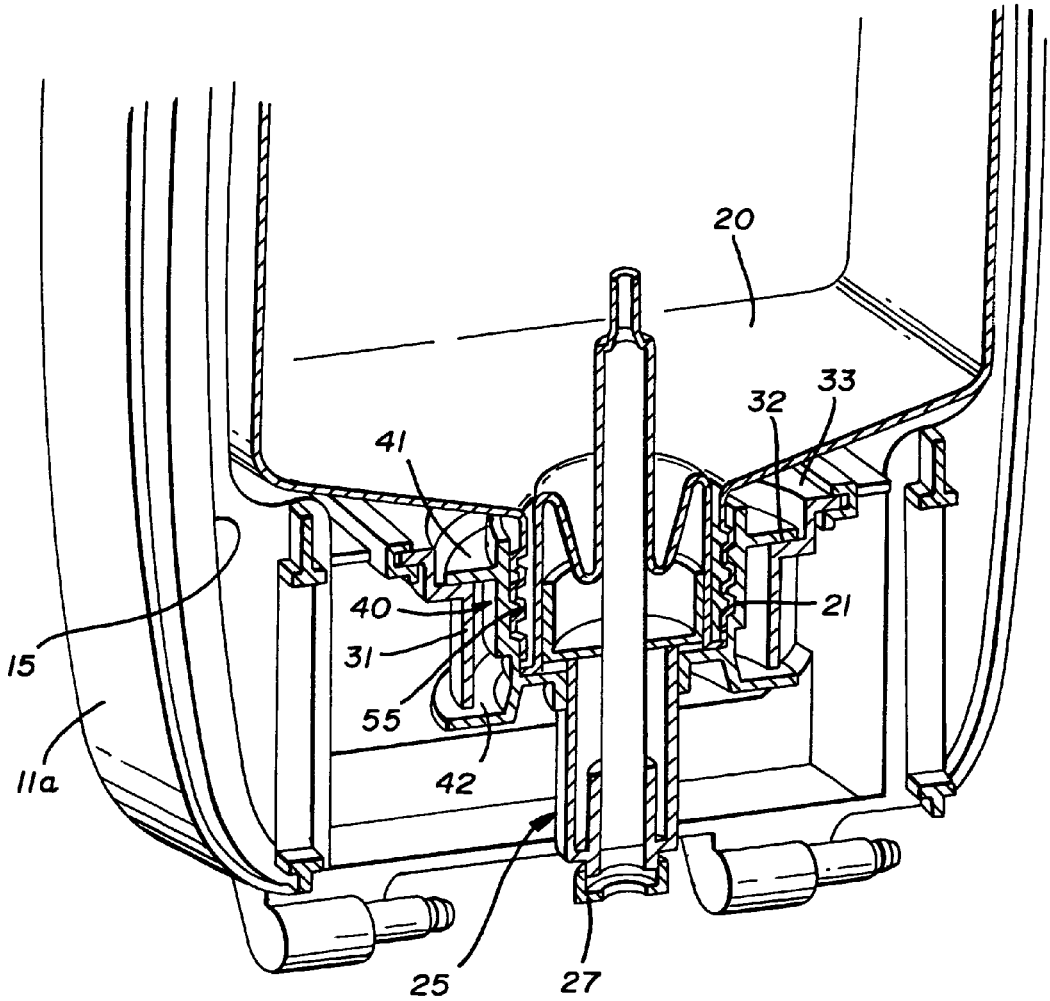
FIG. 3 is an enlarged perspective view similar to FIG. 2 sectioned to show details of the container, pump, and universal pump collar.
Figure 4:
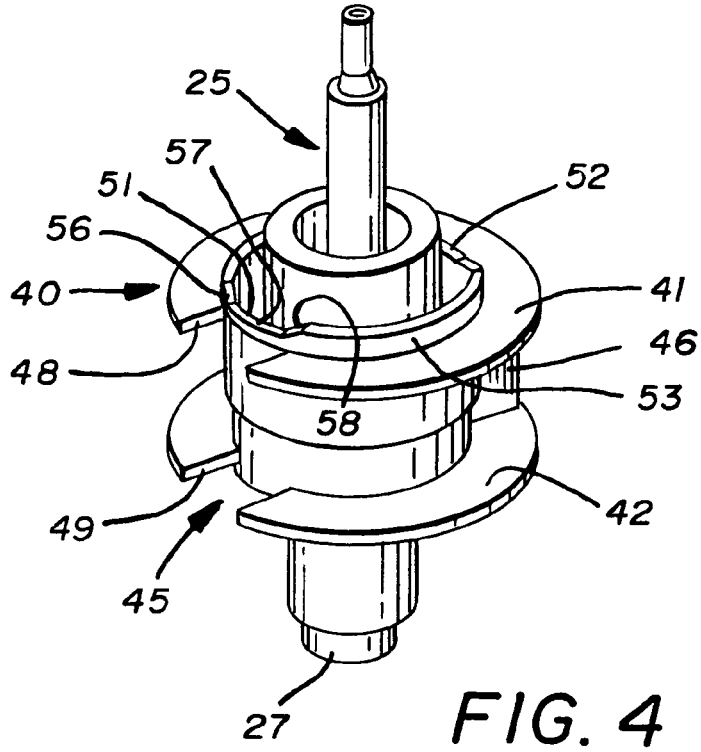
FIG. 4 is a top perspective view of a pump collar according to the concepts of the present invention.

A pump generally indicated by the numeral 25, is typically attached to or formed integrally with the container 20 for dispensing soap therefrom. As shown, pump 25 may extend downward from container 20 between the shoulders of shelf 32. With reference to FIGS. 3 and 4, pump 25 may, for example, be attached to the container 20 at a neck 21 extending downwardly from container 20, as by a threaded collar 40 that fits over the pump 25 and threads onto the neck 21. As shown, the pump 25 may include an annular rib that rests against the rim at the open end of container neck 21, and collar 40 may hold the pump 25 in place by fitting there over. The nozzle 27 of the pump 25 protrudes axially outward from the collar 40, and, in the example shown, is moved upward to dispense soap from the container 20.

Returning to FIG. 2, it may be seen that base 11*a* may include slide guides 28 a nozzle locating bar (not shown) is mounted, on which to allow the pump 25 to be driven axially inward to pump soap from the container, the locator bar is movable with the nozzle 27 in the axial direction as it rides on slide guides 28. In this way, a handle 12 that interacts with the locator bar may be used to move the nozzle 27 and dispense soap from the container 20. In the example shown, the handle 12 is pivotally attached to the cover 16 and includes rearwardly extending arms (not shown) that engage the locator bar to vertically displace the nozzle 27 and actuate the pump 25.

A receiver 30 is located between slide guides 28 and is generally adapted to receive a collar key. As discussed previously, existing dispensers employ collar keys to ensure a unique fit between a given container 20 and housing 11. Typically, the collar carries a projecting key, and the receiver 30 defines a keyway specific to a given collar key. For example, the receiver 30, shown in FIG. 2, might have a keyway in the form of a vertical slot. A matching collar key would have a vertical key projecting therefrom and located such that the key would fit into the keyway on the receiver 30. A collar having the wrong key could not be fully inserted preventing its associated container from being used in that dispenser. As will be appreciated, to key multiple containers 20 and housings 11, a variety of keyway arrangements have been established for individual receivers 30.

With that in mind, a universal collar key according to the concepts of the present invention is generally indicated by the numeral 40 in the drawings, may be used to bypass the keying system. Before describing the universal collar key 40 in detail, it should be understood that the term "universal," as used herein, refers to the collar key's ability to work with more than one receiver 30.

Returning to the receiver 30, it may include a key plate 31 that is shaped to receive the collar 40 and, as shown for example in FIG. 2, may have a C-shaped key plate 31 defining a semi-circular opening into which the collar 40 may be received. A shelf 32 may be formed in receiver 30 and extend rearward above the key plate 31. The shelf 32 like key plate 31 may be semicircular. In the example shown, the shelf 32 is recessed from a top surface 33 (FIG. 3) of receiver 30 to generally form a semi-circular recessed area, with the shelf 32 extending radially outward of the key plate 31. Locating tabs (not shown) may extend upwardly from a central portion of the shelf 32 to aid the user in positioning the container 20 within the recess 15, as by the interaction with a projection 34 formed on the container 20. For example, a projection 34 extending rearwardly from the center of container 20 may be aligned between the locating tabs and then inserted therebetween. Similarly, a ramp 35 formed below keyplate 31 may help locate the container 20 by interacting with collar 40, as described more completely below. In this way, the shelf 32 and ramp 35 also provide some vertical support for the container 20.

Figure 5:
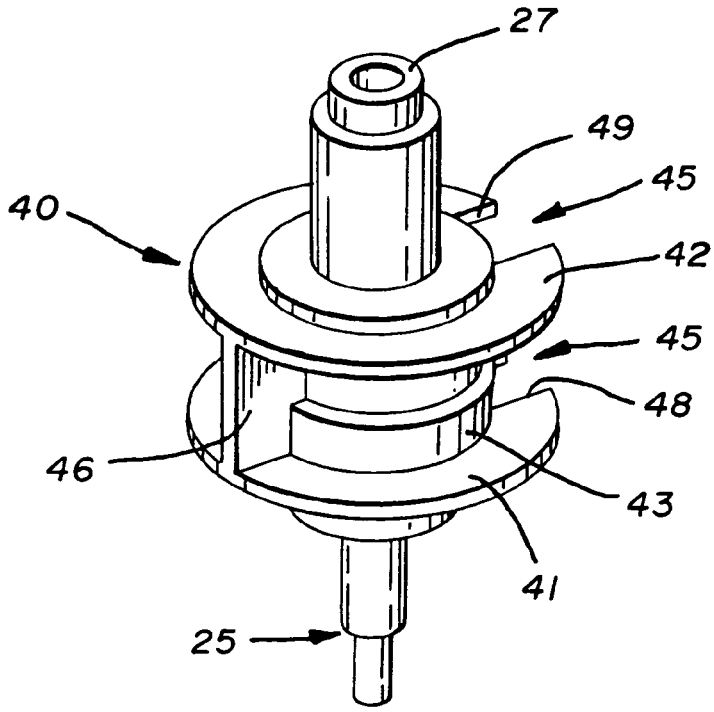
FIG. 5 is a bottom perspective view of a pump collar according to the concepts of the present invention.

As best shown in FIGS. 4 and 5, a universal collar according to the concepts of the present invention is generally indicated by the numeral 40. As shown, the universal collar 40 may be attached to the pump 25. It being understood that use of the word "attachment" includes integral formation of the pump 25 and collar 40. The collar 40 generally includes a first flange 41 and a second flange 42 that each extend radially outward from the collar body 43 or pump 25. Flanges 41 and 42 are axially spaced to define a clearance 45 for receipt of the keyplate 31 therebetween. To that end, flanges 41 and 42 may be spaced a distance generally equal to the height of the keyplate 31. It will be appreciated that flanges 41, 42 need only extend rearward to receive the keyplate 31 and limit axial movement of container 15.

It will be appreciated that flanges may have any form suitable for contacting the keyplate 31 and/or receiver 30 to axially secure the container 20. The generally planar horizontally extending flanges 41, 42 are provided as one example, for simplicity any projection suitable for contacting the receiver 30 or keyplate 31, as previously described will be included in the use of the term "flange" herein.

In the example shown, a vertical rib 46 extends between the first and second flanges 41, 42 providing strength and a hold for the user. The vertical rib 46 may also limit rotation of the collar 40, which may result from deformation of the container 20, by interacting with a surface of the cover 11*b*. In the example shown, to facilitate this use, the vertical rib is located on the forward side of the collar 40.

Notches 48 and 49 are defined in the flanges 41, 42 opposite the rib 46. These notches provide a clearance for the locating tabs and ramp 35, described above, found on the receiver 30. Interaction between the edges of the flanges 41, 42 defining notches 48, 49 with the locating tabs or ramp 35 further limit rotation of the collar 40.

Since the container 20 often contains projections 34 used to locate a collar key on the container 20, the collar 40 may include locating recesses 51, 52 defined within the top edge 53 of collar 40 to receive these projections 34.

As best shown in FIG. 3, to attach the collar 40 and pump 25 to the container 20, the bore 54 of collar 40 may be provided with internal threads 55 to thread the collar 40 onto the neck 21 of the container 20. As discussed previously, the collar 40 may be attached in other ways as well. To allow for receipt of the projection 34 on container 20 as the collar is rotated for attachment, the recesses 51, 52 may have sloped sides or, as shown in FIG. 4, one side 56 may be oblique and the other side 58 stand perpendicular to the base 57 of the recess 51 or 52. In this way, while the oblique side 56 provides clearance of the projection as the collar 40 is threaded onto container 20, the perpendicular side 58 acts as a stop, squarely contacting the projection 34, preventing rotation of the collar 40 that could cause misalignment between the collar 40 and container 20.

In use, the pump 25 with universal collar 40 attached, may be threaded onto the neck 21 of the container 20 before inserting the container 20 within the housing 11. As best shown in FIG. 3, the axially spaced flanges 41, 42 respectively fit over and under the keyplate 31 to locate the pump 25 at the proper height and axially secure the container 20 within the dispenser 10. The keyless rearward surface of the collar 40 is able to fit against the keyplate 31 allowing full insertion of the container 15 regardless of any keyways K on keyplate 31. Thus, container K may be used with any number of keyplates 31.

While a full and complete description of the invention has been set forth in accordance with the dictates of the patent statutes, it should be understood that modifications can be resorted to without departing from the spirit hereof or the scope of the appended claims.

What is claimed is:

1. A universal collar secured to a container used in a dispenser having a keyplate with a keyway that is adapted to receive a complementary shaped collar key associated with an intended container, the universal collar comprising:

a body defining an axial bore and having a first flange and a second flange, said bore extending at least between said first flange and said second flange, wherein said flanges extend radially outward and are axially spaced from each other for receiving the keyplate therebetween, wherein said body includes a keyless surface between said first and second flanges such that the universal collar bypasses the keyway of the dispenser, wherein said flanges are connected on a forward side of the universal collar by a vertically extending rib, and wherein said flanges define notches on a side of the universal collar opposite said rib.

2. A universal collar that attaches to a pump and, in turn, a container used in a dispenser having a keyplate, the universal collar comprising:

a body defining an axial bore and having a first flange and a second flange, said bore extending at least between said first flange and said second flange, wherein said flanges extend outward and are axially spaced from each other for receiving the keyplate therebetween, wherein said body includes a top edge, said top edge defining a locating recess for receipt of a projection on the container, said recess being axially spaced from said flanges and having a base and a pair of upstanding sides, wherein said sides are circumferentially spaced from each other for receipt of the projection therebetween, and wherein said flanges define notches on a side of the universal collar.

3. The universal collar of claim 2, wherein one of said sides extends perpendicular to said base and the other of said sides extends obliquely relative to said base.

4. The universal collar of claim 2, wherein said top edge extends axially upward relative to said first flange and extends in a circular fashion to circumscribe a portion of the container.

* * * * *

UNITED STATES PATENT AND TRADEMARK OFFICE

CERTIFICATE OF CORRECTION

PATENT NO. : 7,950,548 B2
APPLICATION NO. : 10/693567
DATED : May 31, 2011
INVENTOR(S) : Nick E. Ciavarella, Mark E. Rosenkranz and Detlev F. Smith It is certified that error appears in the above-identified patent and that said Letters Patent is hereby corrected as shown below:

On the cover page, the inventor name reading "Mark E. Rosendranz" should read "Mark E. Rosenkranz"

Signed and Sealed this
Twelfth Day of July, 2011

David J. Kappos

David J. Kappos
*Director of the United States Patent and Trademark Office*